US007904972B2

(12) United States Patent
Anderson

(10) Patent No.: US 7,904,972 B2
(45) Date of Patent: Mar. 15, 2011

(54) ERGONOMIC CONTOURED URINAL FLOOR MAT

(76) Inventor: Marino Anderson, Boca Raton, FL (US)

( * ) Notice: Subject to any disclaimer, the term of this patent is extended or adjusted under 35 U.S.C. 154(b) by 395 days.

(21) Appl. No.: 12/198,093

(22) Filed: Aug. 25, 2008

(65) Prior Publication Data

US 2009/0139017 A1 Jun. 4, 2009

Related U.S. Application Data

(60) Provisional application No. 61/005,083, filed on Nov. 30, 2007.

(51) Int. Cl.
*E03D 11/00* (2006.01)

(52) U.S. Cl. ..... 4/251.1

(58) Field of Classification Search ..... 4/251.1
See application file for complete search history.

(56) References Cited

U.S. PATENT DOCUMENTS 3,657,745 A * 4/1972 Hickman ..... 4/483
5,282,283 A * 2/1994 Atkin ..... 4/661
5,916,658 A * 6/1999 Mohr ..... 428/81
6,295,658 B1 * 10/2001 Jenkins ..... 4/251.1
2004/0121112 A1 * 6/2004 Burns et al. ..... 428/81

FOREIGN PATENT DOCUMENTS

JP 3155181 * 11/2009

* cited by examiner

*Primary Examiner* — Charles Phillips

(57) ABSTRACT

An ergonomic, contoured urinal floor mat for use with wall-urinals with the purpose of positioning a user center, up and toward a wall-urinal so as to prevent urine spillage and drippings from reaching floor below a wall-urinal. The floor mat consists of a heavy duty, permanent material with topside anti-slip and floor conforming anti-skid surfaces and is designed with three unique contouring angles which, in combination, elevates heels above toes, spreads legs, pushes toes outward, pulls heels inward, and creates a lift in the inner arch of the foot. The system also incorporates a replaceable drip tray, located between the users' legs and the urinal lip (to catch the inevitable last drops), a topside perimeter gutter (for complete urinal misses), and underside seal (to prevent liquids seepage under mat). If spills do occur, the overall contouring guides liquid into the gutter and keeps the topside foot areas dry.

17 Claims, 6 Drawing Sheets

ERGONOMIC CONTOURED URINAL FLOOR MAT

CROSS-REFERENCE TO RELATED APPLICATIONS

This invention related to Provisional Patent application No. 61/005,083, filed Nov. 30, 2007, confirmation number 6888, title ergonomic contoured urinal mat (please note that the title is now slightly different).

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The present invention relates to an ergonomic, contoured urinal floor mat for use with wall-urinals with the purpose of positioning the user so as to prevent urine spillage, drippings, and/or spatter from reaching floor below a wall-urinal and/or onto users' pants and/or shoes. In as such, the floor is kept dry which reduces probability of falls, free from urine (and its derivative corrosive agents, uric acid and ammonia) which attacks the floor and surrounding wall(s) and fixtures (such as urinal dividers), and free from resultant unsanitary conditions (caused bay stagnant liquids, whether on the floor or accumulating in saturated, expired absorbent pads).

2. Description of the Prior Art and Utility

The use of urinal drip prevention apparatuses is known in the prior art and utility. More specifically, urinal drip prevention apparatuses heretofore devised and utilized for the purpose of preventing urine from being deposited upon a floor directly below a urinal are known to consist of familiar, expected and obvious structural configurations, notwithstanding numerous designs encompassed by the crowded prior art which have been developed to fulfill countless objectives and requirements.

Previous designs of drip prevention apparatuses have only addressed the symptom of urine drippings and spillage outside the area of the wall-urinal; these apparatuses have included urinal lip guards, objects to convince users to use better aim, and absorbent pads. None of the apparatuses force a change in user position to achieve dry floor.

Description of Related Art including information disclosed under 37 CFR 1.97 and 1.98.

By way of example, the following references are pertinent:

U.S. Pat. No. Des. 259,225 to Scheer discloses a urinal deflector.

U.S. Pat. No. Des. 329,893 to Luedtke et al. discloses an anti-splash mat for urinal or the like.

U.S. Pat. No. Des. 332,302 to Brown discloses an anti-splash back unit for a urinal screen.

U.S. Pat. No. 2,057,162 to Richey discloses a water-absorbent mat comprising a single ply of sheet material, and a moisture-proof backing, the mat having a semicircular opening to fit in front of a lavatory.

U.S. Pat. No. 4,044,405 to Kreiss discloses a target in a bowl or urinal to attract the attention of urinating human males.

U.S. Pat. No. 5,027,448 to Wilkins discloses a men's anti-splashback hygienic urinal.

U.S. Pat. No. 5,282,283 to Ryan discloses a urination station with a pair of foot mats straddling a urinal basin.

U.S. Pat. No. 5,448,783 to Ryan discloses a drip guard for use on the lip of the mouth of the urinal.

U.S. Pat. No. 6,295,658 to Jenkins discloses a disposable pad having a plurality of layers, and means for retaining the disposable pad either upon the upper surface of a permanent base or directly onto the floor. The base has an upper surface that is generally horizontal and is constrained to a single, front to back slope.

BRIEF SUMMARY OF THE INVENTION

This invention is the first and only design to address the root cause of urine drippings and spillage outside the area of the wall-urinal. The root cause of urine drippings outside the area of the wall-urinal is primarily caused by the distance between the user and the urinal. As the stream of urine is started and stopped, some of the liquid will fall in the space between the user and the urinal. Aggravating the situation, the user typically arches backward which can cause the urinary tract to compress; a compressed urinary tract may create a condition of weak flow which, in turn, may cause multiple flow start/stops.

This invention proposes a solution to the root cause of urinal drippings by slightly lifting the user up and forward toward the wall-urinal, reducing the space between the user and the wall-urinal. Additionally, by splaying the feet outward, lifting heels and inner arches, the users' hips are rotated back and the pelvis thrust forward. The rotated hips and forward thrust pelvis may enhance urine from the bladder relieving compression on the users' urinary tract.

While prior inventions fulfill their respective, particular objective and requirements, the aforementioned patents do not describe an ergonomic contoured urinal floor mat for use with wall-urinals that is readily installed or removed using no tools and prevents the floor directly below a wall-urinal from being damaged from urine drippings by the positioning the user closer to the wall-urinal while directing urine drippings into a mat gutter and preventing liquids from entering the underside of the mat. Nor do the aforementioned patents use any type of a drip tray with anti-splash/anti-spatter material to address the problem of drop spatter and/or pooled liquids which present a slipping hazard and unsanitary environment. Some of the aforementioned patents use liquid absorbing pads in or near the near foot area and such pads act like a sponge to dampened the shoes of new users with the liquid from prior users; that liquid is subsequently tracked dangerously (due to slippage on both the floor and the mat) and unsanitarily throughout the establishment. Absorbent pads act primary to contain liquid but do not address issues related to drop splash and/or spatter from reaching beyond foot areas and/or user shoes, feet, ankles, legs, and/or pants.

In this respect, the ergonomic, contoured urinal floor mat for use with wall-urinals according to the present invention substantially departs from the conventional concepts and designs of the prior art and utility, and in doing so provides an apparatus primarily developed for the purpose of preventing urine spillage from reaching and dips from accumulating on a floor area below a wall-urinal.

Therefore, it can be appreciated that there exists a continuing need for new and improved wall-urinal apparatuses which can be used for preventing urine spillage from reaching and drips from accumulating on a floor area below a wall-urinal. In this regard, the present invention substantially fulfills this need.

BRIEF DESCRIPTION OF THE SEVERAL VIEWS OF THE DRAWINGS

The invention will be better understood and objects other than those set forth above will become apparent when consideration is given to the following detailed description thereof. Since the invention is highly contoured in three dimensions, the second figure shows a view to define perspective while the third figure shows a different angle. Such description makes reference to the annexed drawings wherein.

DETAILED DESCRIPTION OF THE INVENTION

In the view of the foregoing disadvantages inherent in the known types of urinal drip prevention apparatuses now present in the prior art, the present invention provides an improved urinal floor mat for use with wall-urinals. As such, the general purpose of the present invention, described below, is to provide a new and improved urinal floor mat via ergonomic contouring for use with wall-urinals and method which has all the advantages of the prior art and none of the disadvantages.

To attain this, the present invention comprises a urinal floor mat, contoured in three dimensions, with a top-side anti-slip surface, bottom-side anti-skid material, integrated top-side perimeter gutters, and bottom-side perimeter seal and drip tray to catch spillage. The mat foot zone is designed to fit in the space directly in front of a wall-urinal where a wall-urinal user would normally stand—this space is also commonly used by existing urinal floor mat designs.

The system benefits establishment owners by eliminating wet floors and benefits the user by arresting errant drips on pants and spatter on shoes while both the establishment owners and users benefit from enhanced safety by preventing the users' shoes from becoming wet with urine and being tracked throughout the establishment.

Figure 4:
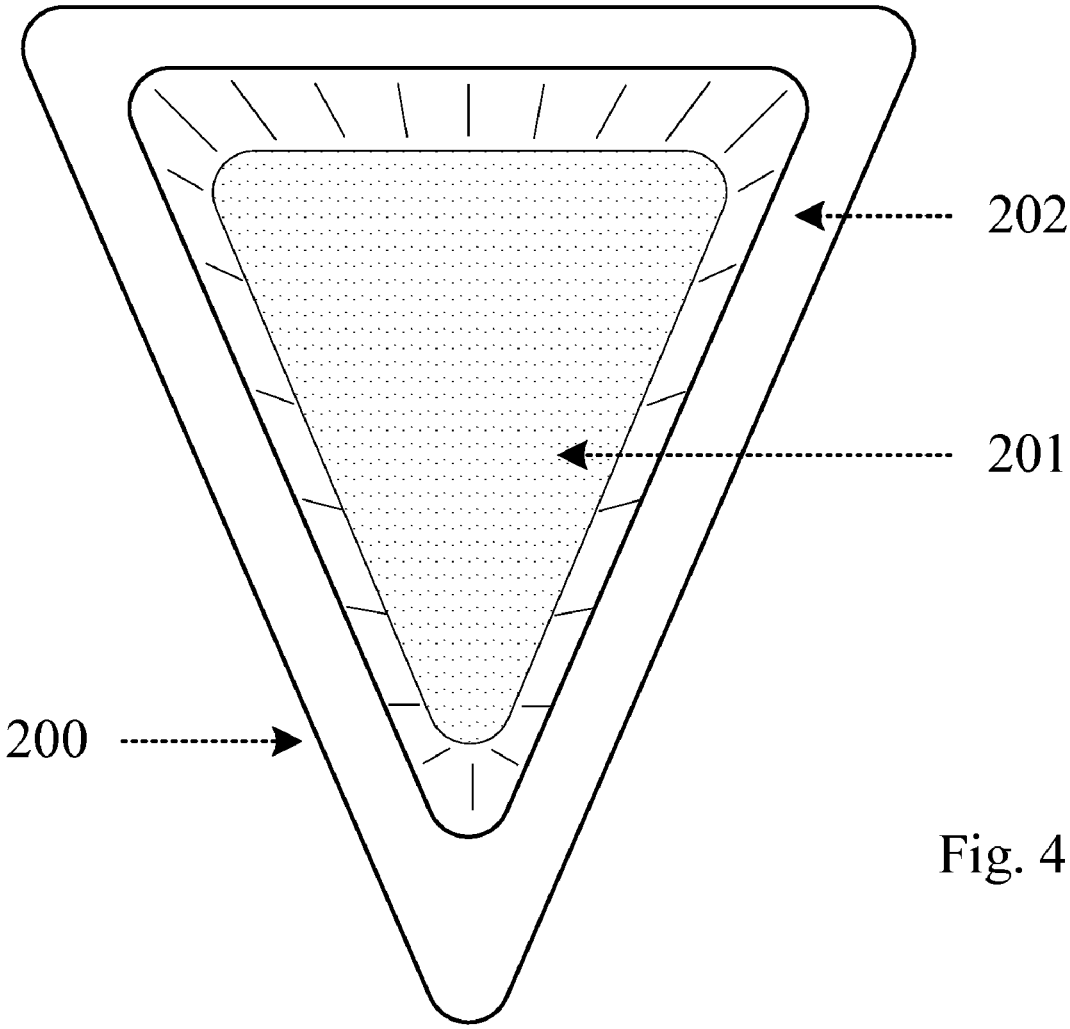
FIG. 4 is a top view drawing of the drip tray with perspective depth of the tray thereof.
Figure 5:
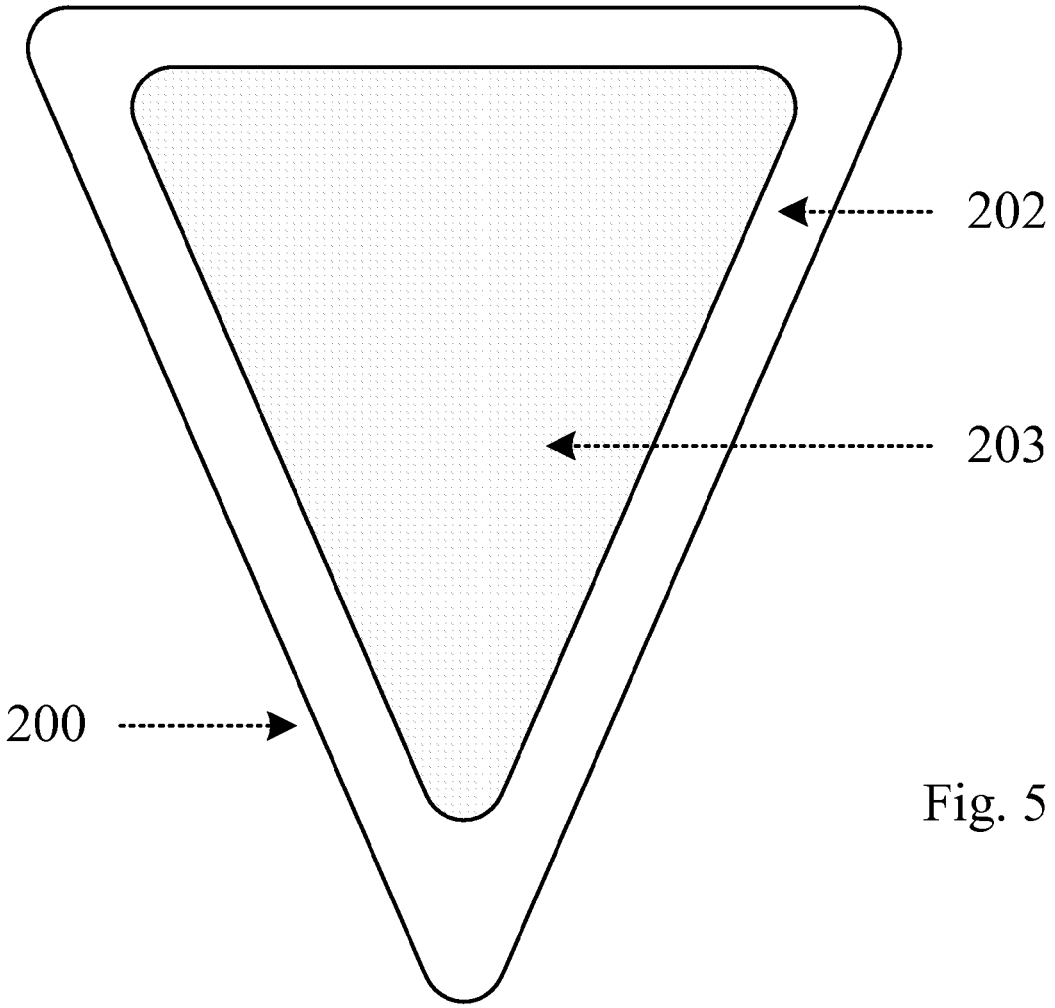
FIG. 5 is a top view drawing of the drip tray with anti-splash layer thereof.
Figure 6:
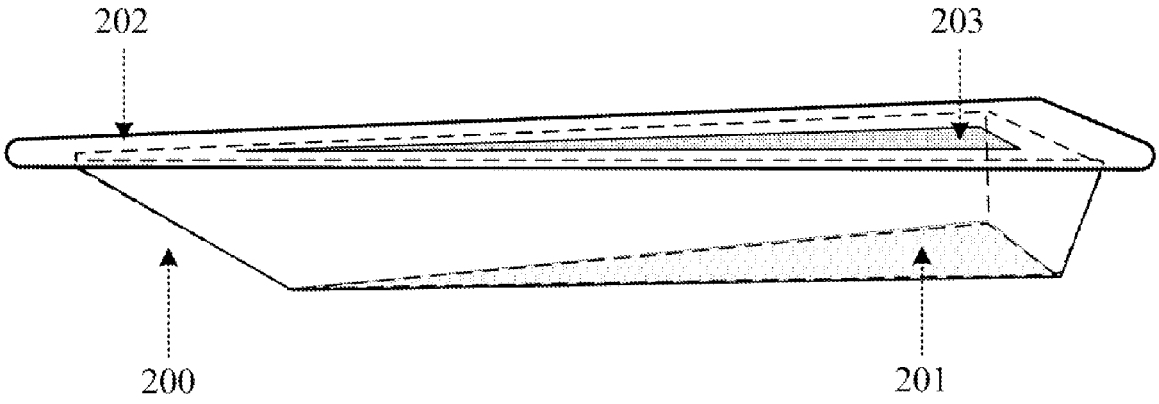
FIG. 6 is a side view drawing of the drip tray with perspective depth of the tray thereof.

The surface contouring consists of multiple angles that guide the user's feet so that:

i. Heels are elevated above toes ii. Legs are spread slightly iii. Top of foot is pushed outward iv. Heels are pushed inward v. Inner arch of the foot is elevated FIGS. 1, 2, and 3 describe the mat at different angles and, thus, the references within the three figures are the same. The left and right of the mat are mirror copies, thus, the descriptions for the left side apply to the right. FIGS. 4, 5, and 6 describe the drip tray at different angles and, thus, the references within the three figures are the same.

Figure 1:
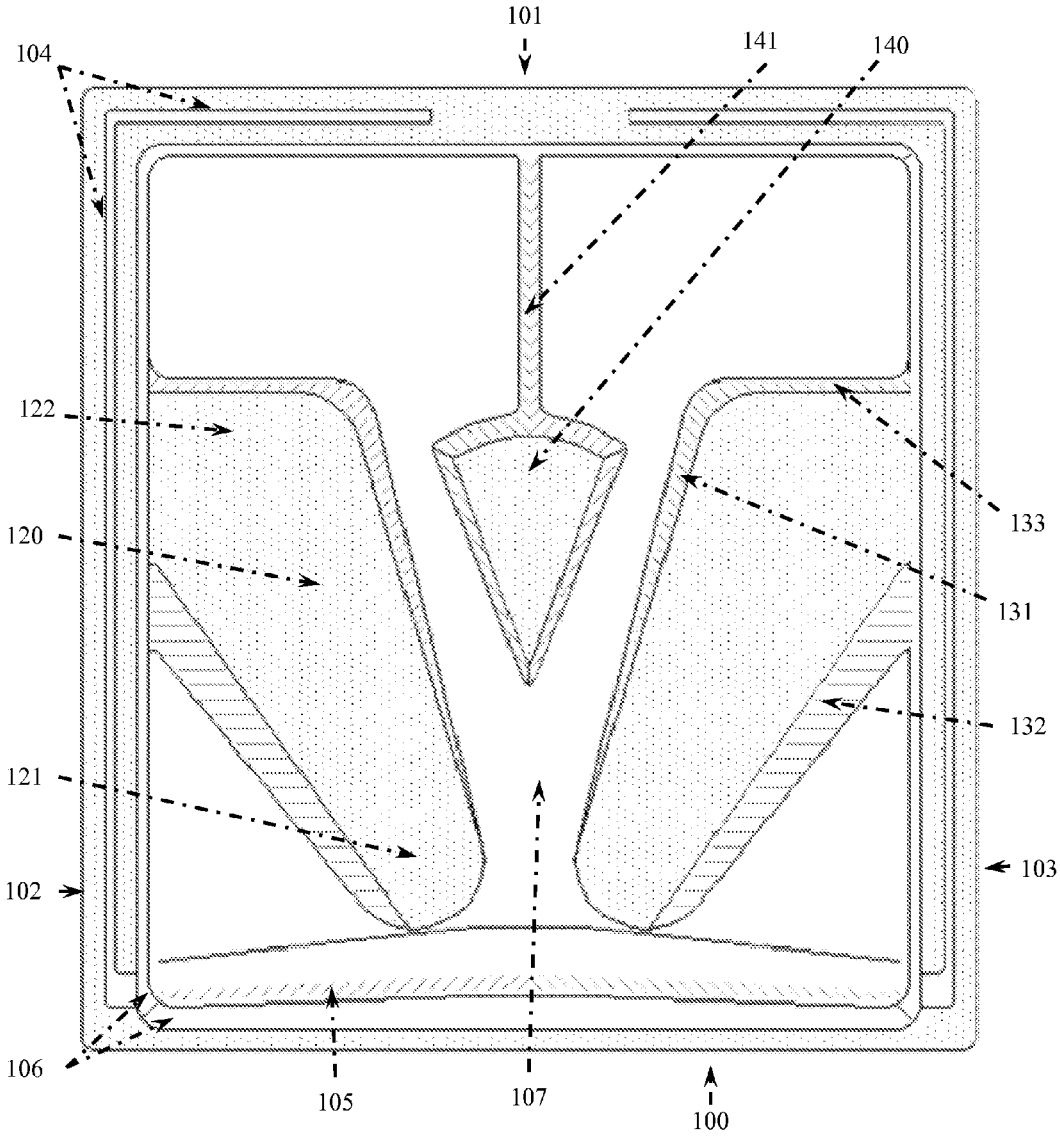
FIG. 1 is a top view drawing of the mat (a view from directly from the top from the perspective of the user) view thereof.
Figure 2:
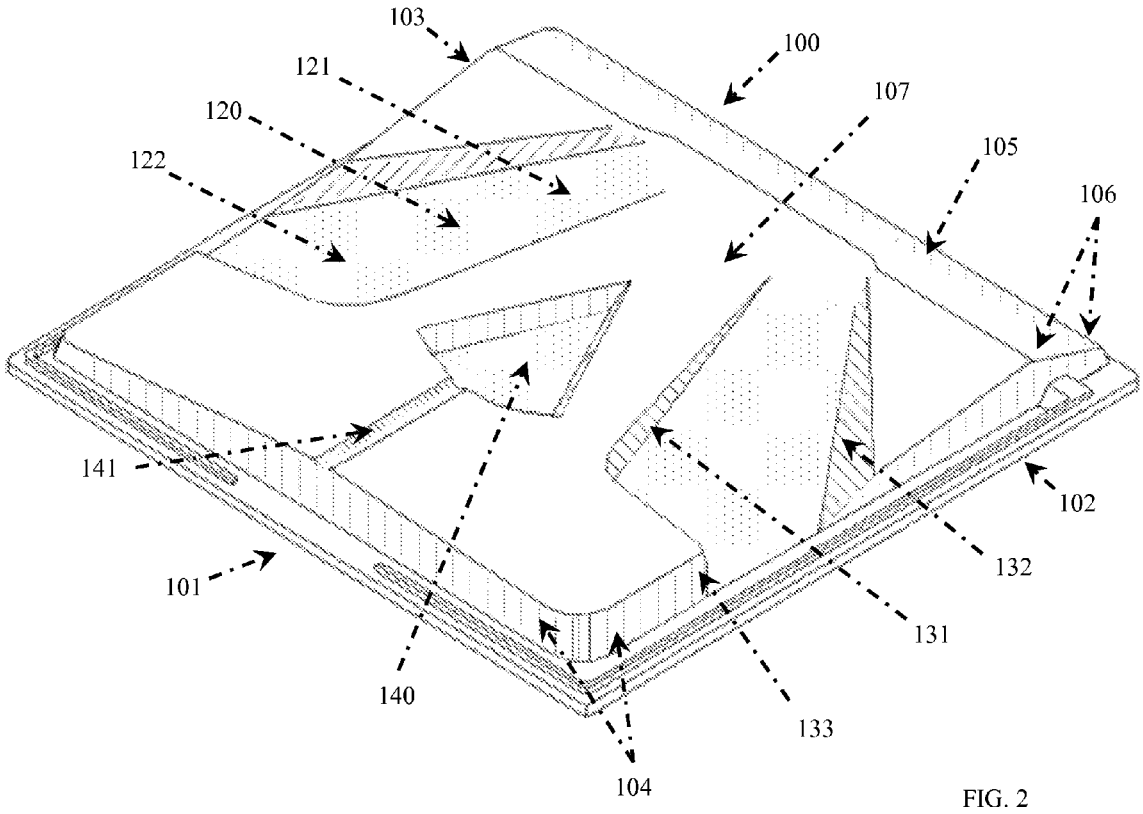
FIG. 2 is a top view drawing of the mat with rear perspective (a view from the urinal wall) view thereof.
Figure 3:
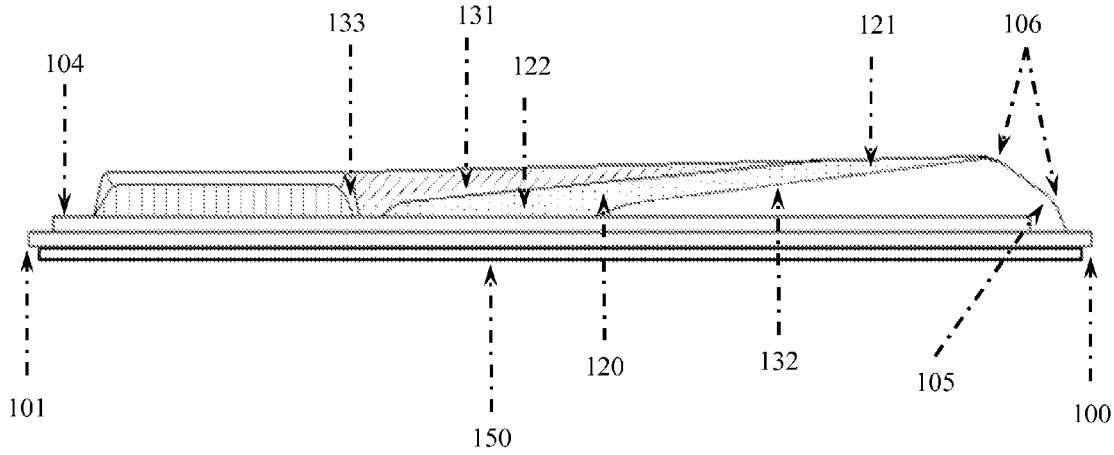
FIG. 3 is a side view drawing of the mat thereof.

For FIGS. 1, 2, and 3 the mat is described as front [100] (side facing away from wall area and where user first comes onto the mat), rear [101] (side facing the urinal wall), left [102], and right [103]. Each foot will be positioned in the foot zone [120]. At the front [100] of the mat is the heel area [121]. At the rear [101] of the mat is the toe area [122]. Foot zones [120] are coated with water-safe, anti-slip material which may or may not be shaped like a shoe sole.

Front-to-Rear descending slope—foot zone [120] is higher at the front [100] than the rear [101] to elevate the user heel [121] above the toes [122]. The top side of the mat is higher at the front [100] than the rear [101] but the sloping is flatter than that of the foot zone [120].

Front-to-Rear center ridge [107]—a ridge spanning from front [100] to the rear [101] of the mat and equally spaced between the left [102] and right [103] sides is designed to position the user directly in-line with the wall-urinal as well as spread legs slightly. The width of the ridge is smaller at the front [100] than the rear [101] to encourage an offset toe-position.

Rear-Left to middle of mat and Rear-Right to middle mat—to encourage an offset toe-position, the toe area [122] is angled up toward to the center of the mat [107] and downward to the outer edge of the mat. An inner ridge [131] located on both the rear-left-middle and rear-right-middle is designed to prevent the user toe from pointing inward. An outer ridge [132] located on both the rear-left-middle and rear-right-middle is designed to prevent the user toe from going beyond from the heel area [121].

Front-Left to middle of mat and Front-Right to middle of mat—to encourage an inset heel position, heel area [121] is angled up toward the center of the mat [107]. An outer ridge [132] on both left and right rear sides is designed to prevent the user heel from going beyond from the heel area [121].

Front step [105]—Contoured, beveled edge area [106] to permit ease of stepping up and prevent tripping.

Rear—Designed with stop zone [133] to prevent user foot/shoe from advancing beyond toe area [122].

Shaping—the contoured shape of the mat contains beveled edges to avoid sharp angles to enhance overall ergonomics and safety while avoiding user slippage. From the center of the mat, the overall top surface (excluding foot zones [120]) is slightly convex to ensure excess spillage will flow into perimeter gutter [104].

The mat is made of any material, including but not limited to any type of plastic, any type of metal, any type of ceramic, any type of porcelain, any type of rubber, any type of wood, any type of fiber-glass, any type of carbon-fiber, any type of synthetic material, any type of organic material, any type of inorganic material. Any method may be used to construct the mat, including but not limited to hollow or solid fill, casting, injection, molding, vacuum-forming, hydro-forming, welding, gluing, bonding, die-cut, and/or extrusion.

The mat surface contains any type of coating and/or pattern, including but not limited to roughened, siping, gritty, blocked, treaded shapes to prevent wear and/or slippage and/or display any type of trademark or logo. The mat can have any color or combination of colors and method of colorization, including but not limited to natural material color, died material color, stained, painted, impregnated, and/or infused.

Generally, the top of the mat is constructed of and/or includes an anti-wear, non-slip material (for any type of shoe sole and/or bare feet) while the bottom of the mat is constructed of and/or includes an anti-skid material [150] and/or design (adaptable to any type of flooring, including but not limited to concrete, tile, wood, laminates carpeting).

The topside perimeter may or may not include any design (including but not limited to a groove or gutter) to prevent liquid runoff from reaching the floor [104]. The bottom of the mat may or may not include any material that forms a seal

[150] between the mat and the floor to prevent liquid from reaching the underside of the mat. Additionally, the seal [150] will be sufficiently flexible to fill irregularities in the floor, including but not limited to grout lines. The center of the mat may or may not include any design or device of any size and/or material that acts to catch drippings from the user and/or urinal; also referred to as a drip tray receptacle [140]. A channel [141] between the rear of the drip tray receptacle [140] and the rear of the mat [101] is cut into the top of the mat to permit drainage of excess liquid in the drip tray receptacle [140]. The channel [141] also serves as a means insert a finger to grab the outer lip flange [202] of the drip tray [200].

For FIGS. 4, 5, and 6 the drip tray [200] is described as any design which is designed to fit within the mat's drip tray receptacle [140]. The drip trap bottom [201] is sufficiently deep to contain any volumes of material (which includes, but is not limited to absorbent and/or disinfectant and/or deodorizer). The top of the drip tray incorporates an anti-splash material [203] to prevent drop spatter while allowing liquid to penetrate and reach the absorbent material. The outer top perimeter of the drip tray incorporates a lip flange which is exceeds the outer proportions of the tray; the purpose of the lip flange is to prevent liquids from falling between the mat [100] and the drip tray [200] and, thus, accumulating in the drip tray receptacle [140].

The overall angles incorporated into the mat [100] lift user slightly up and slight forward, bringing the user closer to urinal and in a stance that is more directly over the urinal; however the intention is not to force a straddle position as this may soil the pants of the user. The position reduces space between the user and the urinal and reduces spillage during the beginning and ending of urination. The purpose is to catch spillage in the drip tray [200]. From a top view, contouring is not overly obvious and, complimented with an optional shoe outline, user will know without instruction where to place feet as he would an ordinary flat object. Position may potentially benefit the user by naturally relieving pressure on urinary tract, encouraging a higher rate of flow.

From the above specification, it is evident that many alternatives, modifications, and variations of the urinal floor mat system of the present invention will be apparent to those skilled in the art in light of the disclosure herein. It is intended that the metes and bounds of the ergonomic, contoured urinal floor mat be determined by the appended claims rather than by the language of the information provided above, and that all such alternatives, modifications, and variations which form a conjointly cooperative equivalent are intended to be included within the spirit and scope of these claims.

What is claimed and desired to be protected by Letters Patent of the U.S. is as follows:

1. An ergonomic, contoured urinal floor mat for use with wall-urinals with the purpose of properly positioning a wall-urinal user to prevent urine drippings from reaching a floor surface below a said wall-urinal, comprising in combination:

a contoured floor mat that gives users no easy alternative but to stand in a required position on said mat while using said wall-urinal, said mat having a right and a left side extending between a front and a rear and said mat having an upper surface, a right foot receiving zone and a left foot receiving zone, said zones forming indentations in said upper surface, each foot zone being formed with a foot receiving surface that is sloped from the front to the rear causing the user's heels to be elevated above his toes, said zones being oriented such as to cause the user's legs to be spread slightly with the toes of the user's feet being further apart than the heels.

2. The mat of claim 1 comprising a drip tray that fits within the center of the ergonomic, contoured urinal floor mat for the purpose of containing errant drops or spillage from the user and/or urinal, avoiding spatter onto the mat and/or user shoes, feet, ankles, legs and/or pants and ensuring that mat remains dry and clean.

3. The mat of claim 1, the contoured shape of the mat contains soft/beveled edges to avoid sharp angles and to avoid user slippage and tripping potential.

4. The mat of claim 1, constructed one of one of the following, plastic, any type of metal, any type of ceramic, any type of porcelain, any type of rubber, any type of wood, any type of fiber-glass, any type of carbon-fiber, any type of synthetic material, any type of organic material, any type of inorganic material.

5. The mat of claim 1, any method may be used to construct the mat, including but not limited to hollow or solid fill, casting, injection, molding, vacuum-forming, hydro-forming, welding, gluing, bonding, die-cut, and/or extrusion.

6. The mat of claim 1, wherein the surface may be roughened or gritty, blocked, and formed to limit wear and/or slippage and is capable of displaying any type of logo.

7. The mat of claim 1, having any color or combination of colors and method of colorization, including but not limited to natural material color, died material color, stained, painted, impregnated, and/or infused.

8. The mat of claim 1, wherein the top of the mat is constructed of and/or incorporates a permanent anti-wear, non-slip material for any type of shoe sole and/or bare feet.

9. The mat of claim 1, wherein the bottom of the mat incorporates a permanent anti-skid material and/or design which is adaptable to any type of flooring, including but not limited to concrete, tile, wood, laminates, and carpeting.

10. The mat of claim 1, wherein a top perimeter of the mat may include a groove or gutter to prevent liquid runoff from reaching the floor.

11. The mat of claim 1, wherein the bottom of the mat may include any material that forms a seal between the mat and the floor to prevent liquid from reaching the underside of the mat.

12. The mat of claim 1, wherein the center of the mat may include a drip tray of any design or any size and/or material, permanent or disposable that acts to catch drippings from the user and/or urinal.

13. The mat of claim 1, wherein the overall contouring of the mat, inclusive of the topside foot and non-foot zones are designed such that any liquids making contact, will flow to the sides and/or the front and/or the rear with the purpose of keeping the mat dry.

14. The mat of claim 1, wherein said foot zones are surrounded with foot guides for the purpose of limiting foot travel, the foot guides consist of raised edges at a front thereof, except at the outer mid foot to outer front foot to permit an exit path for any liquids that may find their way into the foot zone.

15. The mat of claim 2, including a container designed to fit within the drip tray receptacle and to be filled with an absorbent material.

16. The mat of claim 15, including a lip flange at the top the drip tray that prevents liquids from seeping between the drip tray container and cavity of the drip tray receptacle and, thus, accumulating in the drip tray receptacle.

17. The mat of claim 2, including a cover designed to arrest drops and minimize/eliminate spatter while permitting liquid to be absorbed by a material below the tray.

* * * * *